US011261570B2

(12) United States Patent
Dong et al.

(10) Patent No.: US 11,261,570 B2
(45) Date of Patent: Mar. 1, 2022

(54) ADAPTIVE BALANCING MECHANISM OF DUAL-HEAD CEMENT TROWELLING MACHINE

(71) Applicant: JiangSu University, Jiangsu (CN)

(72) Inventors: Lili Dong, Jiangsu (CN); Jun Yao, Shanghai (CN); Zeyuan Miao, Jiangsu (CN); Xiaotie Niu, Beijing (CN); Lan Zou, Beijing (CN)

(73) Assignee: JiangSu University, Jiangsu (CN)

( * ) Notice: Subject to any disclaimer, the term of this patent is extended or adjusted under 35 U.S.C. 154(b) by 0 days.

(21) Appl. No.: 16/973,776

(22) PCT Filed: Apr. 10, 2020

(86) PCT No.: PCT/CN2020/084132
§ 371 (c)(1),
(2) Date: Dec. 10, 2020

(87) PCT Pub. No.: WO2020/233271
PCT Pub. Date: Nov. 26, 2020

(65) Prior Publication Data

US 2021/0254291 A1 Aug. 19, 2021

(30) Foreign Application Priority Data

May 22, 2019 (CN) ..... 201910427309.1

(51) Int. Cl.
*E01C 19/42* (2006.01)
*E04F 21/24* (2006.01)

(52) U.S. Cl.
CPC ..... *E01C 19/42* (2013.01); *E04F 21/245* (2013.01)

(58) Field of Classification Search
CPC ..... E01C 19/42; E04F 21/245
USPC ..... 404/112
See application file for complete search history.

(56) References Cited

U.S. PATENT DOCUMENTS 8,998,531 B2 * 4/2015 Hanson ..... E01C 19/42 404/112
2013/0129419 A1 5/2013 Hanson et al.

FOREIGN PATENT DOCUMENTS

| | | |
|---|---|---|
| CN | 2065533 | 11/1990 |
| CN | 204590548 | 8/2015 |
| CN | 208293366 | 12/2018 |
| CN | 110284407 | 9/2019 |
| CN | 110821121 | * 2/2020 |

(Continued)

OTHER PUBLICATIONS

"International Search Report (Form PCT/ISA/210) of PCT/CN2020/084132", dated May 22, 2020, with English translation thereof, pp. 1-4.

*Primary Examiner* — Gary S Hartmann
(74) *Attorney, Agent, or Firm* — JCIPRNET

(57) ABSTRACT

An adaptive balancing mechanism of dual-head cement trowelling machine includes a water tank, a screw support base, an adjusting screw, a sensor and controller, a counterweight, a stepper motor, an underframe, a guide rail, a guide rail support plate, limit plates, and a transmission member. The controller collects the weight change information of the water in the water tank in real time according to the operation process. Adjust the position of the counterweight in real time by the stepper motor and the adjusting screw to make the two trowel heads in adaptive dynamic balance to the ground pressure.

9 Claims, 5 Drawing Sheets

(56) References Cited

FOREIGN PATENT DOCUMENTS

| | | |
|---|---|---|
| WO | 2018132598 | 7/2018 |
| WO | 2018231881 | 12/2018 |

* cited by examiner

ADAPTIVE BALANCING MECHANISM OF DUAL-HEAD CEMENT TROWELLING MACHINE

CROSS-REFERENCE TO RELATED APPLICATION

This application is a 371 of international application of PCT application serial no. PCT/CN2020/084132, filed on Apr, 10, 2020, which claims the priority benefit of China application no. 201910427309.1, filed on May 22, 2019. The entirety of each of the above mentioned patent applications is hereby incorporated by reference herein and made a part of this specification.

BACKGROUND

Technical Field

The invention relates to an adaptive balancing mechanism of dual-head cement troweling machine and an adjusting method thereof, which is mainly applied to cement concrete floor and belongs to the field of construction machinery.

Description of Related Art

Cement concrete pavement has been used in China for a long time and has a wide range of applications. Cement concrete pavements are laid on highways, urban roads, airport runways, stations, docks, and rural roads. The development of cement concrete pavements has good economic and social benefits. Terrazzo polishing floor is a composite floor material with cement as the main raw material. It has the advantages of low cost, moisture resistance, and good performance. According to statistics from relevant national departments, the area of terrazzo used in public buildings nationwide exceeds 6 billion square meters.

The concrete surface needs to be lightened after the initial setting and before the final setting. The surface after machine construction is smoother and smoother than the manual construction surface, and it can greatly improve the compactness and wear resistance of the concrete surface. Trowel machine is the first choice in concrete construction. It can be widely used in the high-standard factory buildings, warehouses, parking lots, squares, airports, and frame-type buildings. The grinding time of terrazzo polishing is related to the strength of the cement slurry and the temperature. The high strength of the cement slurry takes a lot of time to grind the surface. If the strength is too low, the negative pressure generated on the bottom surface when the surface is polished and rotated easily pulls the cement slurry into a groove or remove the stones. Therefore, there should always be water under the shaving head when grinding to flush the ground stone and remove it in time.

At present, most domestic drivable trowel machines are not equipped with a water tank. The lack of water will reduce the quality of concrete pavement operations. In addition, China utility model patent No. CN208293366U discloses a novel driver-type trowel machine, which mainly includes a first top plate, a second top plate, a first motor, a second gear unit, a water tank, a water pipe and a connecting rod. The dust suction plate absorbs dust generated during operation, the water tank and spray head reduce the temperature of the trowel machine to prevent the blade from being damaged by high temperature work. Also equipped with shock absorbing device to ensure the comfort of the occupants. This patent improves the quality of a certain operation and has many advantages, but it requires two power motors, there will be problems such as coordination of the two power motors, and it also wastes energy.

SUMMARY

The purpose of the present invention is to provide a simple and energy-saving adaptive balancing mechanism and an adjusting method thereof. The adaptive balancing mechanism can change a position of a weight block in real time according to the weight change of the water tank at one end to ensure that the pressure on the ground at both ends of the cement trowelling machine is equal, so as to reduce costs and improve the quality and efficiency.

The technical solution of the present invention is as follows.

An adaptive balancing mechanism of dual-head cement trowelling machine includes a water tank, a guide rail, a screw support base, an adjustment screw, a sensor and a controller, a counterweight, a coupling, a stepper motor, an engine, a flexible shock absorber, two trowel power shafts, two trowel discs, an underframe, a transmission member, a guide rail support plate, a transmission shaft 16 and a water pipe. The guide rail includes a guide rail main body and a guide rail side plate, and a middle portion of the guide rail is connected to an upper end of the support plate through a hinge. The adjusting screw has an end near the engine connected to the stepper motor through the coupling, and the adjusting screw is provided with the counterweight and the screw support base at both ends. The counterweight is adjusted by the sensor and the controller, and the stepper motor to balance a mechanism of the dual-head cement trowelling machine in real time and is supported by the guide rail. Two ends of the underframe are fixed with two trowel power shafts, a wiping disc is installed below each of the trowel power shafts, and a flexible shock absorber is mounted above each of the trowel power shafts. The flexible shock absorber is installed at both ends of the adaptive balancing mechanism of the double-head cement trowelling machine, and inner sides of the upper plates are fixed to the two ends of the guide rail by bolts. The water tank 1 and the engine are respectively installed above the flexible shock absorbers. Two trowel discs are used to trowel the ground and support a frame of the trowelling machine. The transmission shaft is used to transmit the power of the engine to the trowel disc for the trowelling operation, and transmit the power to the other trowel disc through the transmission member for operation. The guide rail support plate includes a first limit plate, a support plate, and a second limit plate. The two limit plates are connected to the underframe by bolts and can be symmetrically arranged on both sides of the support plate. An upper end of the support plate is connected to the guide rail by a hinge, and a lower end is connected to the underframe by a bolt. The counterweight includes a weight block body and a weight block slide plate. The weight block slide plate cooperates with an upper part of the side plate of the guide rail, so that the counterweight maintains a stable attitude and forms a longitudinal straight linear movement. The flexible shock absorber includes an upper plate, a shock absorbing element, and a lower plate. A material of the shock-absorbing element includes rubber and spring.

The advantages of the present invention are mainly as follows. Real-time detection of the weight change of the water in the water tank to adjust the position of the weight block, so that the two trowel heads are in dynamic equilibrium with the ground pressure, and it easy to operate and drive, and have a certain improvement in quality and efficiency compared to similar types of machines, this machine has a simple structure and saves energy; The engine is installed on one side to prevent burns (exhaust gas outlet on one side outwards) and easy to maintain; It is also possible to flexibly select a weight block according to the pressure required for the floor smoothing to further improve the quality and efficiency of the smoothing.

DESCRIPTION OF THE EMBODIMENTS

The structure, principle, and working process of the present invention are described below accompanied with drawings.

Figure 1:
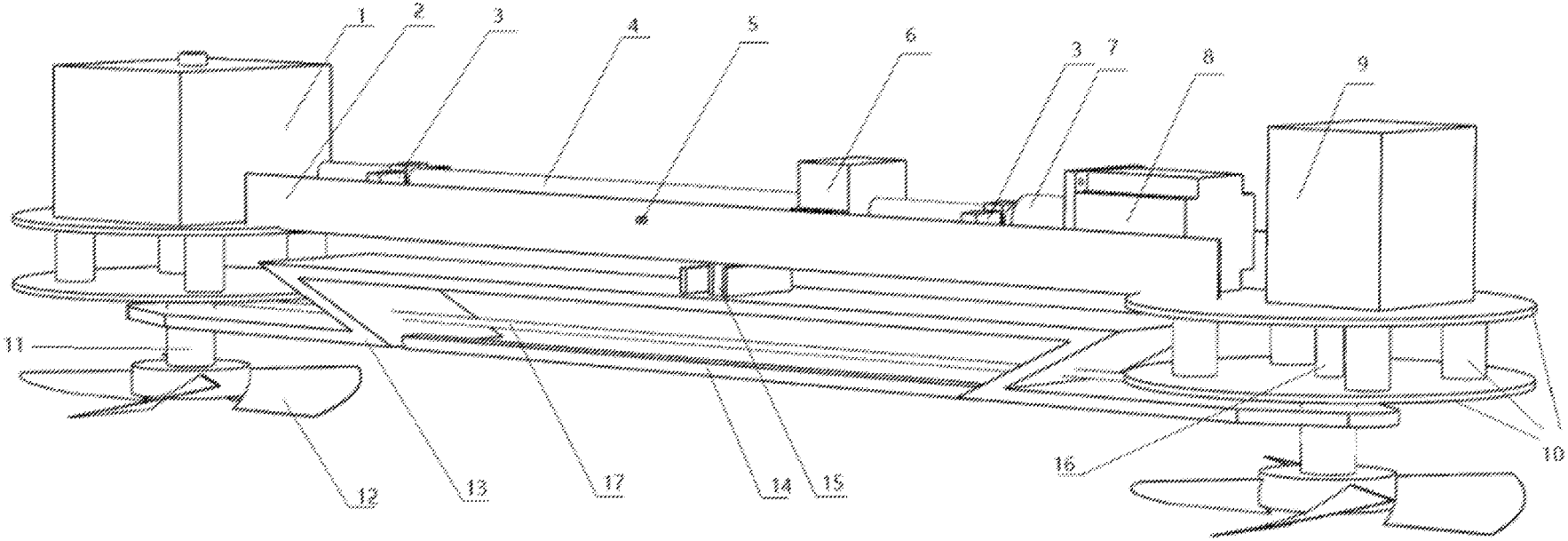
FIG. 1 is a side view according to the present invention.
Figure 2:
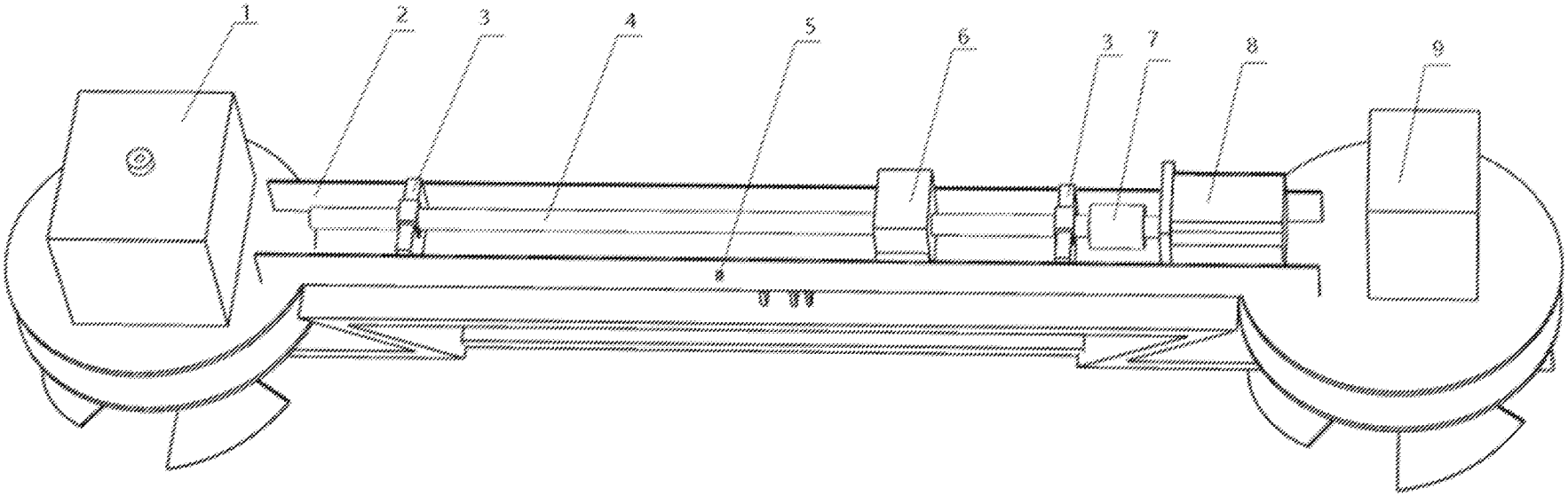
FIG. 2 is a top view according to the present invention.
Figure 3:
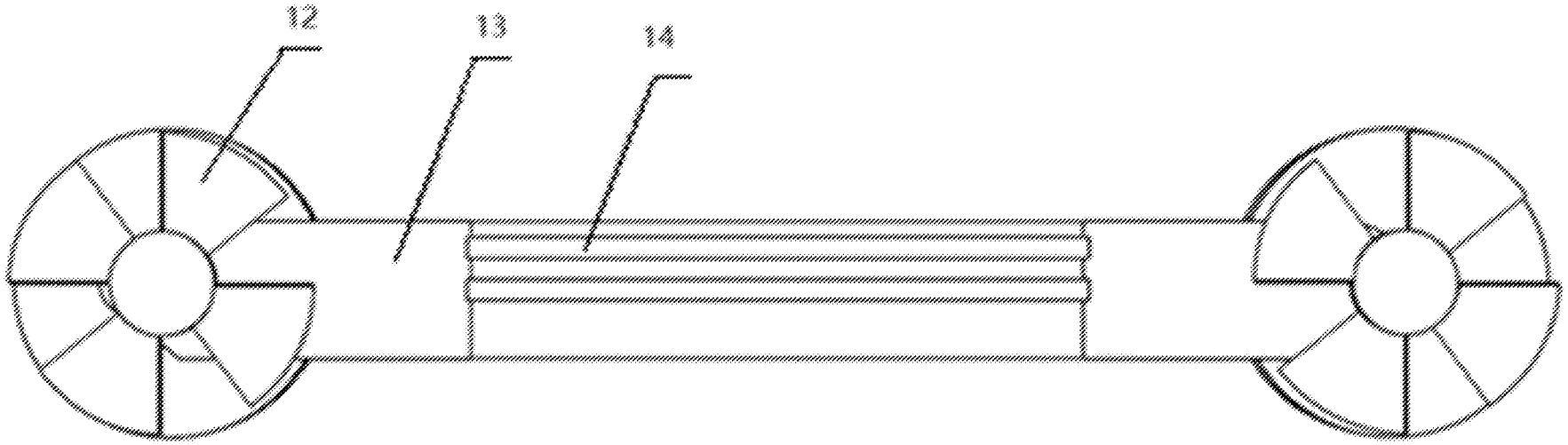
FIG. 3 is a bottom side view of the present invention.

Referring to FIG. 1, FIG. 2 and FIG. 3, the adaptive balancing mechanism includes a water tank 1, a guide rail 2, a screw support base 3, an adjustment screw 4, a sensor and a controller 5, a counterweight 6, a coupling 7, a stepper motor 8, an engine 9, a flexible shock absorber 10, two trowel power shafts 11, two trowel discs 12, an underframe 13, a transmission member 14, a guide rail support plate 15, a transmission shaft 16 and a water pipe 17. The guide rail 2 includes a guide rail body 2-1 and a guide rail side plate 2-2. An end of the adjusting screw 4 near the engine 9 is connected to the stepper motor 8 through the coupling 7, and the counterweight 6 is provided on the adjusting screw 4. The screw support bases 3 are provided on both ends of the adjusting screw 4. The counterweight 6 is adjustable by the sensor and the controller 5 and the stepper motor 8 to balance the whole mechanism of the dual-head cement trowelling machine in real time and is supported by the guide rail 2. Two ends of the underframe 13 are fixedly mounted with two trowel power shafts 11, a wiping disc 12 is installed below each of the trowel power shafts 11, and a flexible shock absorber 10 is mounted above each of the trowel power shafts 11. The flexible shock absorber 10 is installed at both ends of the adaptive balancing mechanism of the double-head cement trowelling machine, and the inner sides of the upper plates 10-1 are fixed to the two ends of the guide rail 2 by bolts, water tank 1 and engine 9 are installed above it. Two trowel discs 12 are used to trowel the ground and support a frame of the trowelling machine. A transmission shaft 16 is used to transmit the power of the engine 9 to one of the trowel discs 12 for the trowelling operation, and transmit the power to the other one of the trowel discs 12 through the transmission member 14 for operation. In the specific implementation, the change signal of the guide rail angle is detected by the sensor, For example, a horizontal angle change of the guide rail is detected by a gyroscope with angle sensor, the water level change signal is detected by a water tank water level sensor, and the water tank pressure change signal is detected by a pressure sensor. The signal detected by the sensor is transmitted to the controller, and the stepper motor is controlled to drive the adjustment screw, and the adjustment screw is driven to move the counterweight to perform adaptive balancing of the adaptive balancing mechanism of dual-head cement trowelling machine.

Figure 4:
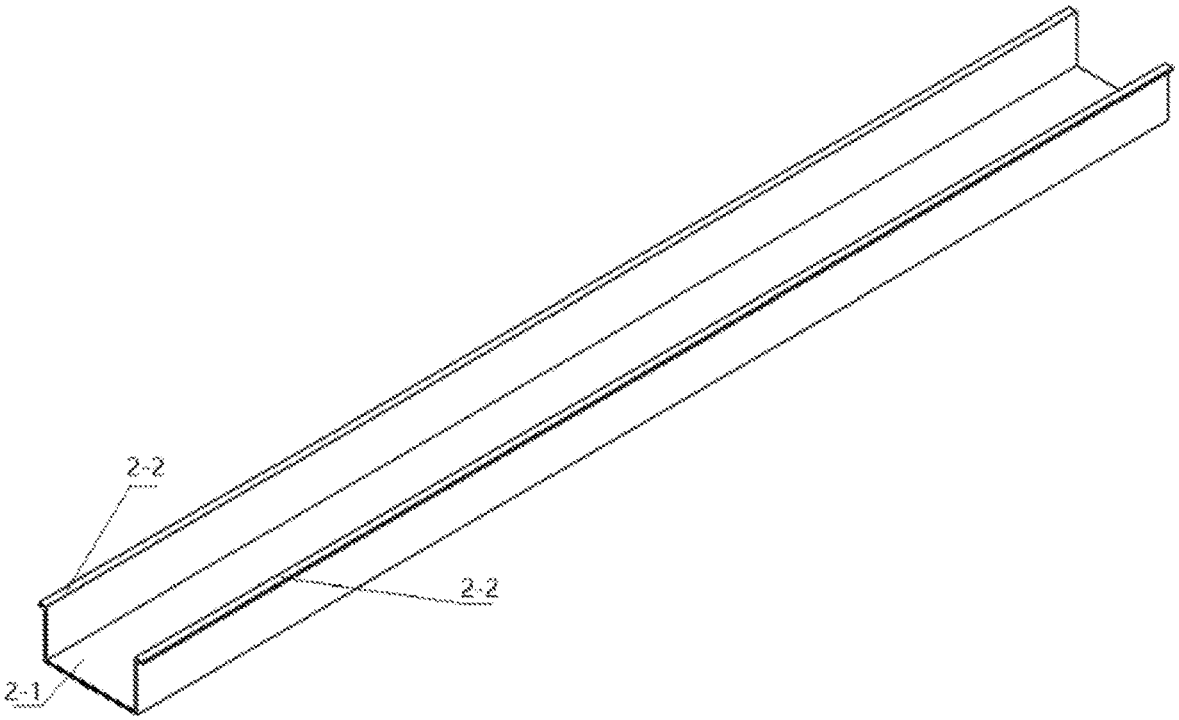
FIG. 4 is a structural view of a guide rail according to the present invention.

Referring to FIG. 4, the guide rail 2 includes a guide rail main body 2-1 and a guide rail side plate 2-2. A middle portion of the guide rail 2 is connected to the upper end of the support plate 15-2 through a hinge. The two ends of the guide rail 2 are respectively fixed to inner sides of the upper plates 10-1 of the two flexible shock absorbers 10 by bolts.

Figure 5:
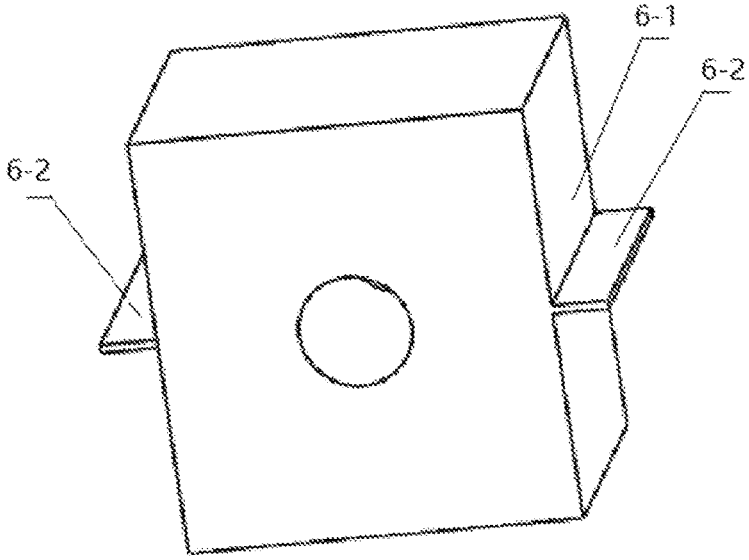
FIG. 5 is a structural diagram of a counterweight according to the present invention.

Referring to FIG. 5, the counterweight 6 includes a weight block body 6-1 and a weight block slide 6-2. The weight block slide 6-2 cooperates with the upper part of the guide rail side plate 2-2 to ensure that the counterweight 6 maintains a stable attitude and forms a longitudinal straight linear movement. The counterweight 6 can also be matched with appropriate weight according to the specific needs of the troweling.

Figure 6:
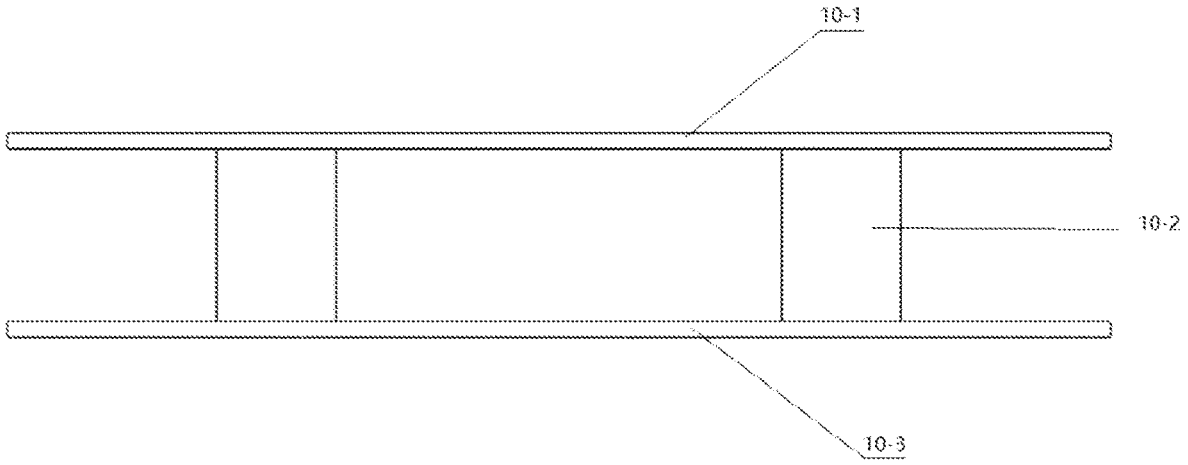
FIG. 6 is a structural diagram of a cushion pad according to the present invention.

Referring to FIG. 6, there are two flexible shock absorbers 10, each of which includes an upper plate 10-1, a shock absorbing element 10-2, and a lower plate 10-3. The material of the shock-absorbing element can be rubber, spring, etc. The inner sides of the upper plates 10-1 are fixed to the two ends of the guide rail 2 by bolts. The water tank 1 and the engine 9 are respectively installed above the upper plates 10-1. The flexible shock absorber 10 and the underframe 13 can reduce the vibration of the engine 9, the transmission component 14 and other external parts, further improving the wiping quality and efficiency of operations.

Figure 7:
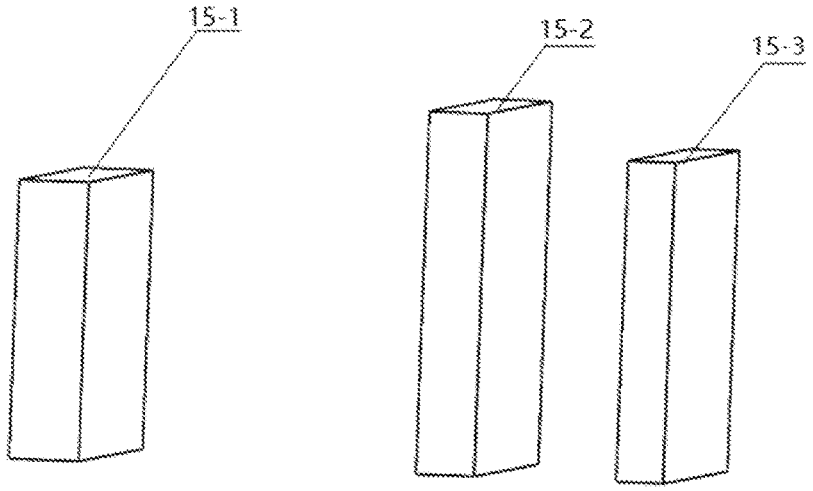
FIG. 7 is a structural diagram of a guide rail supporting plate according to the present invention.

Referring to FIG. 7, the guide rail support plate 15 includes a first limit plate, a support plate 15-2, and a second limit plate 15-3. The first limit plate 15-1 and the second limit plate 15-3 are connected to the underframe 13 by bolts. The upper part of the support plate 15-2 is connected to the guide rail by a hinge, and the lower part is connected to the underframe 13 by a bolt. The limit plates can ensure that the water tank and the engine installed on the flexible shock absorber can be adjusted within a safe height range, and improve the safety and reliability of the adaptive balancing mechanism of the dual-head cement trowelling machine. The height of the limit plate can be changed according to the setting of the inclination angle at both ends.

The balance adjustment process of the adaptive balancing mechanism of dual-head cement troweling machine according to the present invention is as follows.

a) First, filling the water tank of the dual-head cement troweling machine with enough water.

b) Secondly, the weight of the water tank at one end of the troweling machine gradually decreases with the continuous use of water in the water tank during operation of the dual-head cement troweling machine.

c) Subsequently, the weight change at one end of the troweling machine causes the guide rail 2 to incline, and the sensor and controller 5 send the detected angle change signal of a troweling mechanism to a controller for processing and send a message to control the stepper motor. The stepper motor adjusts a position of the counterweight 6 by driving the ball screw to make the mechanism perform balance adjustment.

d) Finally, as the position of the counterweight 6 moves, an inclination angle of the dual-head troweling mechanism, that is, the inclination angle of the guide rail 2, gradually decreases, until the guide rail 2 is in a horizontal position, the sensor and controller 5 make the stepper motor 8 stop and complete the adaptive balance adjustment of the dual-head cement troweling mechanism.

The embodiment of the preferred implementation manners of this present invention, however, this present invention includes but not limited to the foregoing implementation manners. Any obvious improvements, replacements or variations that can be made by a person skilled in the art without departing from the substantial content of the present invention fall within the protection scope of the present invention.

What is claimed is:

1. An adaptive balancing mechanism, adapted for a dual-head cement trowelling machine, the adaptive balancing mechanism comprising a water tank, a guide rail, a screw support base, an adjustment screw, a sensor and a controller, a counterweight, a coupling, a stepper motor, an engine, an underframe, a transmission member, a guide rail support plate, a transmission shaft and a water pipe, wherein the adjusting screw has an end near the engine connected to the stepper motor through the coupling, and the adjusting screw is provided with the counterweight and the screw support base at both ends;

the counterweight is adjusted by the sensor and the controller, and the stepper motor to balance a mechanism of the dual-head cement trowelling machine in real time; two ends of the underframe are fixedly mounted with two trowel power shafts, a trowel disc is installed below each of the trowel power shafts, and a flexible shock absorber is mounted above each of the trowel power shafts and has an upper plate; inner sides of the upper plates of the flexible shock absorbers are respectively fixed to two ends of the guide rail by bolts, the water tank and the engine are respectively installed above the flexible shock absorbers; the two trowel discs are configured to trowel a ground and support a frame of the trowelling machine; the transmission shaft is configured to transmit power of the engine to one of the trowel discs for operation, and transmit the power to the other one of the trowel discs through the transmission member for operation.

2. The adaptive balancing mechanism according to claim 1, wherein the guide rail includes a guide rail main body and a guide rail side plate, and a middle portion of the guide rail is connected to an upper end of a support plate of the guide rail support plate through a hinge.

3. The adaptive balancing mechanism according to claim 1, wherein the counterweight includes a weight block body and a weight block slide plate, the weight block slide plate cooperates with an upper part of the guide rail side plate of the guide rail, so that the counterweight maintains a stable attitude and forms a longitudinal straight linear movement along the adjustment screw.

4. The adaptive balancing mechanism according to claim 1, wherein each of the flexible shock absorbers includes the upper plate, a shock absorbing element, and a lower plate; a material of the shock-absorbing element includes rubber and spring.

5. The adaptive balancing mechanism according to claim 1, wherein the guide rail support plate includes a first limit, the support plate, and a second limit; first limit plate and the second limit plate are connected to the underframe by bolts and is symmetrically arranged on both sides of the support plate, and a lower end of the support plate is connected to the underframe by a bolt; the second limit plate ensures that the water tank and the engine installed on the flexible shock absorber is adjustable within a safe height range.

6. The adaptive balancing mechanism according to claim 1, wherein the flexible shock absorber and the underframe is able to reduce a vibration of the engine, the transmission component and other external parts.

7. The adaptive balancing mechanism according to claim 1, wherein the stepper motor of the counterweight for real-time adjusting is replaceable by other power including a hydraulic motor.

8. The adaptive balancing mechanism according to claim 1, further comprising a detection sensor, wherein the detection sensor includes a gyroscope, a water level sensor or a water pressure sensor, and the screw support base includes a pair of the screw support bases.

9. An adjusting method of the adaptive balancing mechanism of the dual-head cement trowelling machine according to claim 1, the adjusting method comprising:

a) filling water into the water tank, wherein a weight of the water tank gradually decreases with continuous use of the water in the water tank during operation of the dual-head cement trowelling machine;

b) a weight change of the water tank causes the guide rail to incline, sending an angle change signal detected by the sensor and controller of a trowelling mechanism of the dual-head cement trowelling machine to a controller for processing and sending a message to control the stepper motor, driving a ball screw by the coupling to adjust a position of the counterweight, and performing adaptive balance adjustment by the trowelling mechanism; and c) as the position of the counterweight, an inclination angle of trowelling mechanism, which is an inclination angle of the guide rail, gradually decreases, until the guide rail is in a horizontal position, stopping the stepper motor by the sensor and controller, and completing the adaptive balance adjustment of the trowelling mechanism.

* * * * *